United States Patent [19]

Hann

[11] 3,993,198

[45] Nov. 23, 1976

[54] TELESCOPIC COLUMN CRANE FOR STORES IN PARTICULAR FOR CARGO HOLDS

[75] Inventor: Mieczyslaw Hann, Szczecin, Poland

[73] Assignee: Politechnika Szczecinska, Szczecin, Poland

[22] Filed: Apr. 3, 1975

[21] Appl. No.: 564,724

[30] Foreign Application Priority Data

Apr. 3, 1974 Poland ..... 170059

[52] U.S. Cl. ..... 212/127; 212/3; 214/15 R; 214/654; 214/670; 214/16.4 A

[51] Int. Cl.[2] ..... B66C 19/00

[58] Field of Search..... 214/14, 15 R, 730, 16.4 A, 214/654, 670; 105/155; 212/18, 28, 124, 3, 127, 128; 294/103

[56] References Cited

UNITED STATES PATENTS

| | | | |
|---|---|---|---|
| 2,555,297 | 5/1961 | Smith et al. | 214/15 R |
| 3,061,111 | 10/1962 | Riemenschneider | 212/128 X |

FOREIGN PATENTS OR APPLICATIONS

| | | | |
|---|---|---|---|
| 88,452 | 10/1955 | Denmark | 214/654 |
| 1,072,041 | 9/1954 | France | 214/15 R |
| 906,816 | 2/1954 | Germany | 105/141 |

*Primary Examiner*—Frank E. Werner
*Attorney, Agent, or Firm*—Edwin E. Greigg

[57] ABSTRACT

A telescopic crane for stores, in particular for cargo holds, designed for transportation and storage of loads placed in stacks or on racks, which consists of a two-girder bridge with the crane movably mounted thereon, and includes a crab with a rotary platform and a telescopic column with a clamp. The telescopic column has a mobile set of members slidable below or above a fixed member. The fixed member is slidably connected with the rotary platform in order that the fixed member may be lowered together with the other members to a level permitting the turning of the platform.

The end member of the column has a fork and a movable member forming a clamp, which is slidable along the end member by means of a tie system of guiding, which consists of a winch connected with the fixed member and of lifting and lowering ties wound through all members of the column.

In the case of an even number of members, during the movement of these members, the winch is coupled with a driving element for these members. In the case of an odd number of members, the winch is independent. The clamp is provided with a pulley block gear which clamps the load, and is equipped with a ratch that locks the clamp. The two-girder bridge has beams under the track which are of a special design.

4 Claims, 5 Drawing Figures

TELESCOPIC COLUMN CRANE FOR STORES IN PARTICULAR FOR CARGO HOLDS

BACKGROUND OF THE INVENTION

The invention relates to a telescopic column crane for stores, in particular for cargo holds, designed for transport and stacking of loads in stacks or on shelves, in holds or stores.

The hitherto known column of frame store cranes and rack stackers possess a telescopic column consisting of two members of box design, in which the lower one is provided with forks for moving loads. The lifting of the fork with the lower member of the column is realized by means of a rope wound on a drum of a winch, whereby the lifting movement is limited by the stroke of the lower member of the column. The telescopic column is suspended to a crane crab so that it effects a rotary movement relative to the vertical axis, e.g. by means of a gear rim. The crane crab is provided with a traversing gear and with a turning gear of the column and travels on a two-girder crane bridge on which also a traversing gear of the bridge is mounted.

In an another column crane the column is of a fixed length, and it consists of a single member of a closed section, e.g. triangular. Along the column a fork is guided on rollers and the movement of lifting is effected by means of a rope in a double system which is wound on the drum of the winch. The lifting movement is effected within the range of the whole column, which together with a load, rotates around the vertical axis which is achieved by its mounting on the crab and the drive by the turning gear.

A drawback of hitherto known designs of column cranes is the fact that the design of the column makes it impossible to allow a passage of the crane above the piles of loads stacked in layers. These cranes have also a lifting height that is limited by the stroke of the column member, and in the design with a single-member column, by the lower overall dimensions of the bridge. Besides, the known designs of column cranes do not allow the raising of the load above the crane track. On these grounds the application of these cranes is very limited, especially in ships' holds. This leads to a necessity of the application of manual stacking of loads of small unit weights at a simultaneous vertical handling on inclined chutes. These drawbacks are particularly harmful on ships, especially fishing boats working on the sea.

The purpose of the invention is the elimination of these drawbacks and inconveniences by construction of a new lifting device which will ensure a full mechanization of loading operations in a space below and above the crane track with a possibility of the passage above loads stacked in layers with single-man attendance.

SUMMARY OF THE INVENTION

The telescopic crane especially designed for holds, according to the invention, consists of a bridge built of a main box girder and an auxiliary single-web girder, with the crane mounted for movement on the bridge, and comprising a crab with rotary platform, and a telescopic column with a clamp. The telescopic column includes mobile system of members sliding above and below a fixed member slidingly connected with the rotary platform of the crane crab. This connection is made in a known way to ensure the lowering of the fixed member together with the mobile members to a level enabling the turning of the platform together with all members of the telescopic column. The number of members and their length is arbitrary and depends on the height of the mounting of the crane and the height of loads stacked below the crane.

The end member of the telescopic column is provided with a forked clamp sliding along this end member, its movement being independent from the movement of the members. The drive for moving this clamp along the end member is of a tie type and consists of a winch connected with the fixed member and of lifting and lowering ties wound through all members of the column.

In the case of an even number of these members the winch of the clamp is, during the driving by a known method of the mobile members of the column, connected with a driving element. This connection is of such kind that during the movement of the members of the column the tie of the clamp makes a countercurrent compensation movement with a speed equalling the speed of members, which ensures a constant position of the clamp relative to the last member. With an uneven number of members the winch of the clamp is independent and the movement of the clamp has an arbitrary speed.

The forked clamp is provided with a pulley block mechanism equipped with holding-up devices, and at least one ratchet, which automatically clamps the load under the action of its gravitational force, whereby the catches of the tie, which lifts and lowers the clamp, are connected together so that the sum of their lengths remains constant.

The bridge of the crane, due to the side suspension of the column has a main girder of box design and an auxiliary single-web girder. Each of the girders has a beam under the track consisting of a lower flange forming a whole with the lower flange of the proper girder, of an upper flange connected at its whole length with the web of the proper girder, and of a web connected with flanges of the beam and ribs.

The advantage of the crane, according to the invention, consists in that it permits working above high layers of loads stacked by it in rooms of a limited height as, for instance, in ships' holds. Such a design of the crane, according to the invention, enables also the lifting of material above the crane track, e.g. through the hatch opening. As a result, it leads to the full mechanization of loading operations with the introduction of adequately chosen, considerable unit loads and an one-man attendance, which is of particular importance, for instance, in freezing holds. An additional advantage of the crane is the fact that it can be operated in a space above the place of storage of loads, which is an essential requirement on ships in view of the relation of loading operations of the upper deck and between deck holds.

BRIEF DESCRIPTION OF THE DRAWINGS

The subject of the invention is illustrated in an example of a design in the drawings, in which the particular figures show.

DESCRIPTION OF A PREFERRED EMBODIMENT

Figure 1:
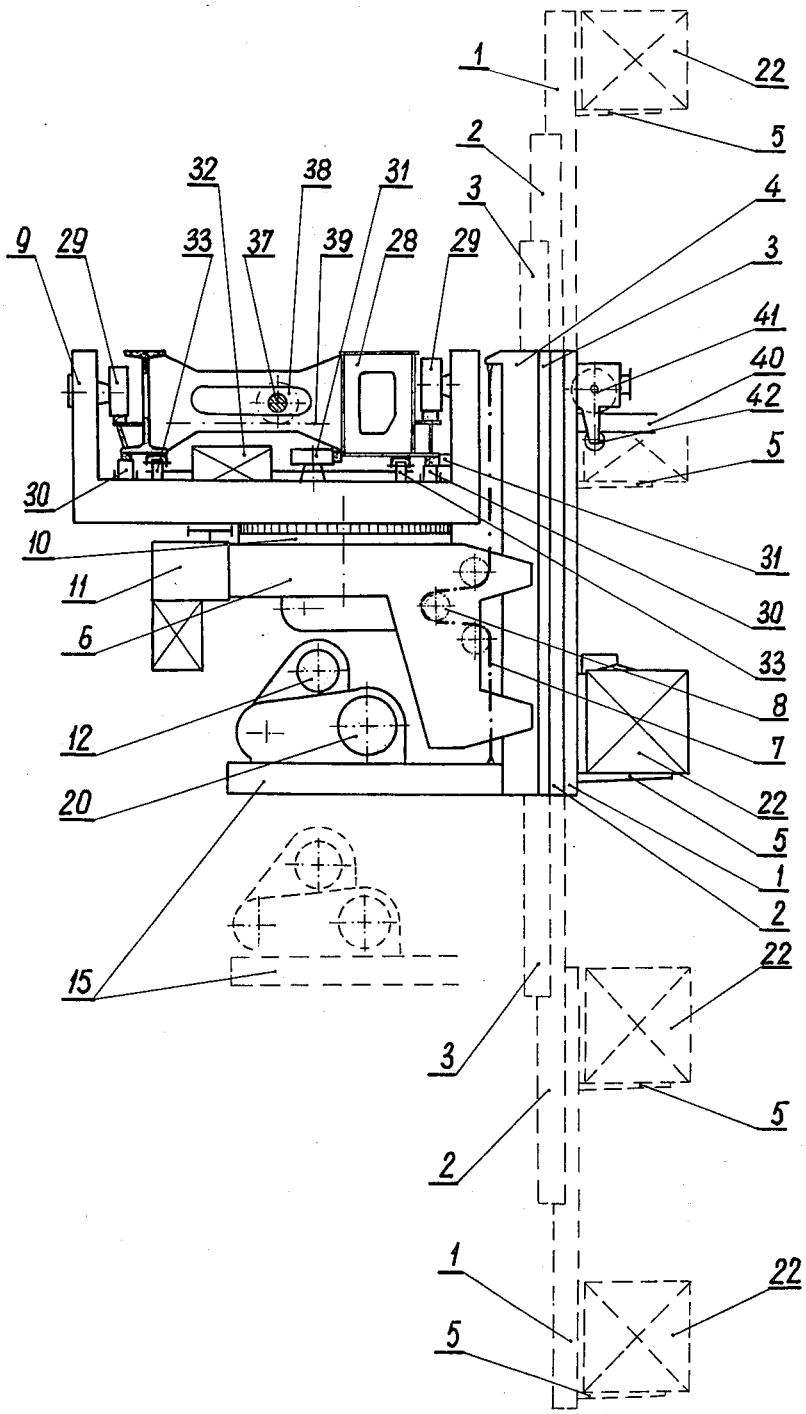
FIG. 1 — a general scheme of the crane in side view.
Figure 2:
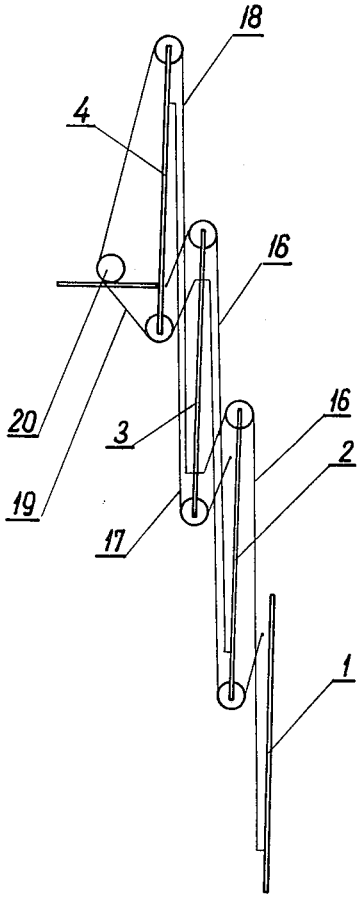
FIG. 2 — a scheme of the tie drive of the column members at their lower position in side view.
Figure 3:
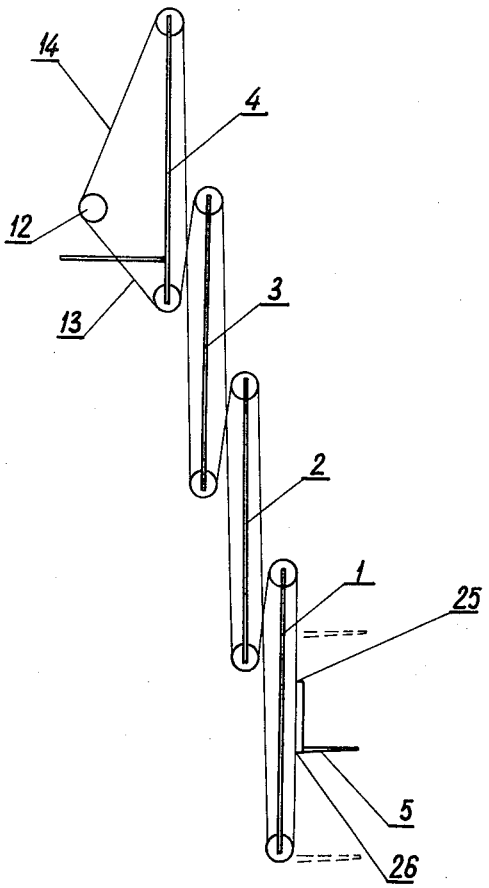
FIG. 3 — a scheme of the clamp with lowered members in side view.
Figure 4:
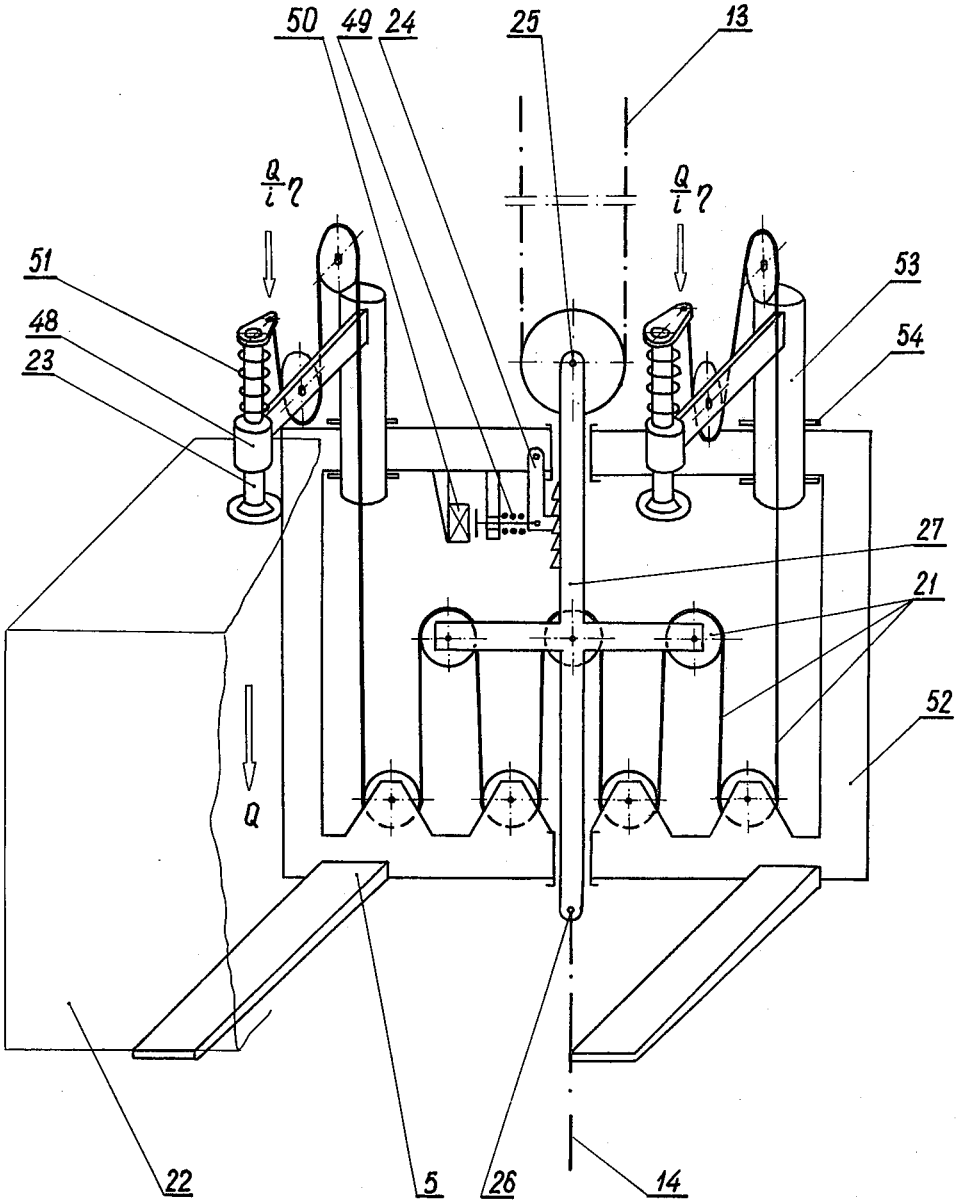
FIG. 4 — a scheme of the clamp in front view.
Figure 5:
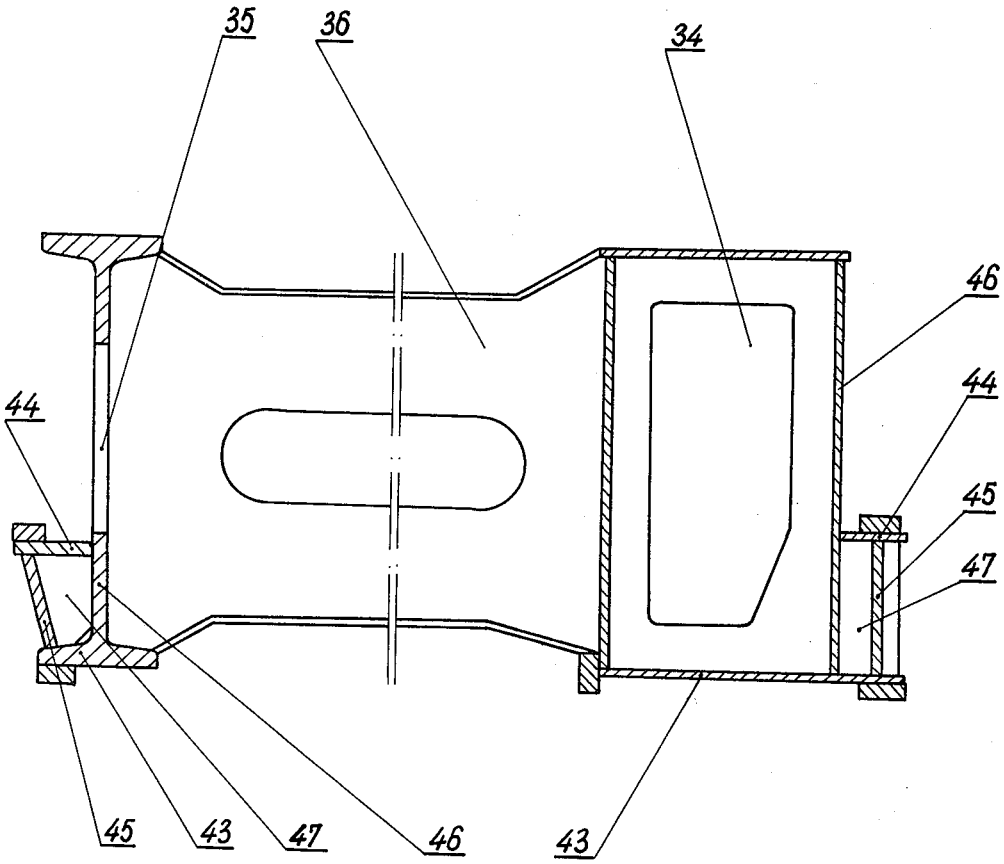
FIG. 5 — a cross section of the girders of the crane bridge.

The telescopic column consists of mobile members 1,2,3 and fixed member 4 of the frame design, which is movably mounted on rollers. The fixed member 4 is connected with the rotary platform 6 slidably and is suspended to it on two parallel bolt chains 7 driven by the winding chain winch 8. The rotary platform 6 is suspended to the crane crab 9 by means of the rim bearing 10 cooperating with the turning gear 11 located on the platform 6. A revolution of the platform is effected after previous lowering by means of the winch 8 of the fixed member 4 together with mobile members 1,2,3 to such a level that the upper edge of the fixed member 4 is positioned below the lower edge of the crane crab 9. This permits the revolution of members 1,2,3,4 of the column together with the clamp 5 beneath the crane crab 9 at an increased lifting height in a composed state of members 1, 2,3,4 in a non-turned position, which also increases the number of layers of loads above which the crane passes.

Along the end member 1 of the column is rolled the clamp 5 driven by the drum winch 4. For transferring the drive from the drum of the winch 12 on the clamp 5 steel ropes are used: the lifting one 13 in a double system and the lowering one 14 in a single system. The drive of the members of the column is effected by ties and consists of guiding chains 16,17 for members 1 and 2 of the column and of steel ropes 18 and 19 for indirect guiding the mobile member 3. These ropes are driven by the driving element 20 in form of a drum, which during the movement of the members 1,2,3 is coupled by an electromagnetic clutch with the winch 12.

This coupling results from the even number of the members of the column. The drive of the members 1,2,3 of the column is doubled, i.e. there are provided two parallel systems of ties 16,17 18,19. The forked clamp 5 has a pulley block gear 21 which clamps the load 22 under the influence of its weight, by means of holding-up devices. The pressure force of the load 22 to the forks of the clamp 5 depends on the weight Q of the load 22 and the transmission ratio $i$ of the pulley block 21 and its efficiency coefficient "$\eta$." The clamping of the load 22 is effected by the movement of ties 13 and 14 in the sense of lifting, which causes the elongation of the bands of the pulley block 21 and, consequently, the lowering of the holding-up devices 23 guided slidably on rollers 38. After the holding-up device 23 has reached the load 22 there follows the lifting of the whole clamp 5 together with the load 22. The maximum pressure force is held by the ratchet 24 pressed on by the spring 49, which is of importance at a rolling of the ship, and the catches 25 and 26 of the ties 13 and 14 are connected together by a rigid connecting piece 27 which prevents a loosening of one of ties 13 and 14 during the operation of clamping or loosening of the load 22.

The loosening of the pressure is effected by the movement of lowering of ties 13 and 14 after previous releasing of the ratchet 24 by the electromagnet 50. This releasing takes place in the moment of arriving of the load 22 on the rest, when the return springs 51 raise the holding-up devices 23.

The adaptation of the level of the holding-up devices 23 to the height of the load 22 is effected by means of stands 53 adjustable relative to the frame 52 and locked by elements 54. The crane crab 9 is guided on a two-girder bridge 28 by means of non-driven travelling wheels 29 and 30 and side rollers 31 ensuring the taking-over of all loads connected with the heels of the ship and movements of the crane. The travel drive of the crane crab 9 is effected by rolling of toothed wheels driven by the gear 32 on two gear racks 33 of a finger type.

The crane bridge 28 consists of two girders: the main box girder 34 and the auxiliary one of a single-web design. Both girders 34 and 35 are connected by walls 36 provided with holes through which the slow running shaft 37 of the travel gear of the bridge passes and drives the toothed wheels 38 meshed with gear racks 39 running along the crane tracks 40.

The whole crane bridge 28 is guided on tracks 40 by means of travel wheels 41 and counter-rollers 42. Each of the girders of the bridge 28 possesses a beam positioned under the track of a design permitting the accommodation of the wheels of the crab 29 within the overall dimensions of the girders 34 and 35. The said beam consists of the lower flange 43 making a whole with the appropriate flange of the girder 34,35, and of the upper flange 44 and the web 45. The upper flange of the beam under the track is fillet welded to the web 46 of the girder 34,35 at the whole length, while the web 45 is fillet welded to both flanges 43 and 44 and to the ribs 47 relative to proper holes.

What I claim is:

1. A telescopic column crane for stores, in particular for cargo holds, consisting of a bridge built of a main box girder and an auxiliary single-web girder with said crane mounted for movement on said bridge and comprising a crab with a rotary platform and a telescopic column with a clamp, characterized in that the said telescopic column has a mobile system of distal, medial and proximate members respectively, slidable below or above a fixed member connected slidably with the rotary platform of the crane crab in order that the fixed member may be lowered together with the mobile members to a level permitting the turning of the platform, said distal member being provided with a fork and a movable member forming a clamp means, said clamp means being slidable along this distal member by means of a tie system of guiding, said system of guiding consisting of a winch connected with the fixed member and of lifting and lowering ties wound through all members of the column.

2. The crane according to claim 1, characterized in that the winch, in the case of an even number of members of the column, is, during the driving of the mobile members, coupled with their element in such a way that the lifting and lowering ties have a speed equalling the relative speed of neighbouring members of the column but of the opposite turn, and at an uneven number of all members of the column the winch of the clamp means is independent and the movement of the clamp means has an arbitrary speed.

3. The crane according to claim 1, characterized in that the clamp means has a pressure pulley block gear provided with holding-up devices and at least one ratchet, whereby, the catches of the lifting tie and the lowering tie on the clamp means are connected together so that the sum of the lengths of these ties be constant.

4. The crane according to claim 1, characterized in that the main box girder and the auxiliary single-web girder of the bridge each has a beam under the track comprising: a lower flange integral with a lower flange of the corresponding girder; an upper flange connected for its whole length with a web of the corresponding girder; and a beam web connected with the flanges of the beam and with the web of the corresponding girder by ribs therebetween.

* * * * *